US005165599A

United States Patent [19]

Owen et al.

[11] Patent Number: 5,165,599

[45] Date of Patent: Nov. 24, 1992

[54] RAIL-TIE FASTENING SYSTEMS

[75] Inventors: S. Hudson Owen, Marshfield, Wis.; Paul A. Wolff, Oklahoma City, Okla.

[73] Assignee: Kerr-McGee Chemical Corporation, Oklahoma City, Okla.

[21] Appl. No.: 817,210

[22] Filed: Jan. 6, 1992

Related U.S. Application Data

[60] Division of Ser. No. 564,939, Aug. 9, 1990, Pat. No. 5,078,319, which is a continuation-in-part of Ser. No. 414,226, Sep. 29, 1989, abandoned, which is a continuation-in-part of Ser. No. 128,174, Dec. 3, 1987, Pat. No. 4,874,128.

[51] Int. Cl.[5] ..... E01B 2/00

[52] U.S. Cl. ..... 238/355; 238/264; 238/287; 238/310; 238/291

[58] Field of Search ..... 238/217, 264, 265, 275, 238/276, 287, 290, 291, 310, 338, 351, 355, 357

[56] References Cited

U.S. PATENT DOCUMENTS

| | | | |
|---|---|---|---|
| 546,810 | 9/1895 | Emrich et al. | 238/291 |
| 571,064 | 11/1896 | Campbell | 238/291 |
| 1,022,790 | 4/1912 | Kupp | 238/265 |
| 1,045,730 | 11/1912 | Murray | 238/290 |
| 1,047,687 | 12/1912 | Myers | 238/290 |
| 1,054,553 | 2/1913 | Hoyt et al. | 238/290 |
| 1,069,756 | 8/1913 | Baston | 238/290 |
| 1,074,942 | 10/1913 | Gates | 238/290 |
| 2,140,917 | 12/1938 | Mahood | 238/338 |
| 4,874,128 | 10/1989 | Owen | 238/355 |
| 5,078,319 | 1/1992 | Owen et al. | 238/355 |

*Primary Examiner*—David A. Bucci
*Assistant Examiner*—James Eller
*Attorney, Agent, or Firm*—Herbert M. Hanegan

[57] ABSTRACT

A rail-tie fastening assembly for connecting a rail having a rail flange to a tie comprising a rail seat assembly and a rail anchor. The rail seat assembly is connectable to the tie and includes an anchor slot and a seat hook assembly. The seat hook assembly is adapted to extend a distance over an upper surface of the rail flange. The rail anchor includes an anchor hook assembly adapted to extend over on the upper surface of the rail flange in an assembled position of the rail anchor to the rail seat assembly. The rail anchor is insertable through the anchor slot in the rail seat assembly to the assembled position. The seat hook assembly is spaced a distance from the upper surface of the rail in the assembled position of the rail anchor to the rail seat assembly. The anchor hook assembly engages one side of the rail flange and the seat hook assembly engages the opposite side of the rail flange to restrain lateral movement. A base anchor is connected to the rail seat assembly and the base anchor is disposable in a cavity formed in an upper surface of the tie and the base anchor is secured to the tie, thereby securing the rail seat assembly to the tie.

7 Claims, 11 Drawing Sheets

RAIL-TIE FASTENING SYSTEMS

CROSS REFERENCE TO RELATED APPLICATIONS

This application is a division of application Ser. No. 07/564,939, filed Aug. 9, 1990, now U.S. Pat. No. 5,078,319, which is a continuation-in-part of the application entitled "Rail-Tie Fastening Assembly" filed on Sep. 24, 1989, U.S. Ser. No. 07/414,226, filed Sep. 29, 1989 now abandoned which is a continuation-in-part of the application entitled "Rail-Tie Fastening Assembly", filed on Dec. 3, 1987, U.S. Ser. No. 07/128,174, now U.S. Pat. No. 4,874,128, issued Oct. 17, 1989 and assigned to the assignee of the present invention.

FIELD OF THE INVENTION

The present invention relates generally to fastening means for securing a railroad rail to a cross-tie. More particularly, but not by way of limitation, it relates to a rail-tie fastening assembly having a rail seat assembly connectable to the tie and a rail anchor removably insertable through a portion of and connectable to the rail seat assembly.

DESCRIPTION OF THE PREFERRED EMBODIMENTS

Figure 1:
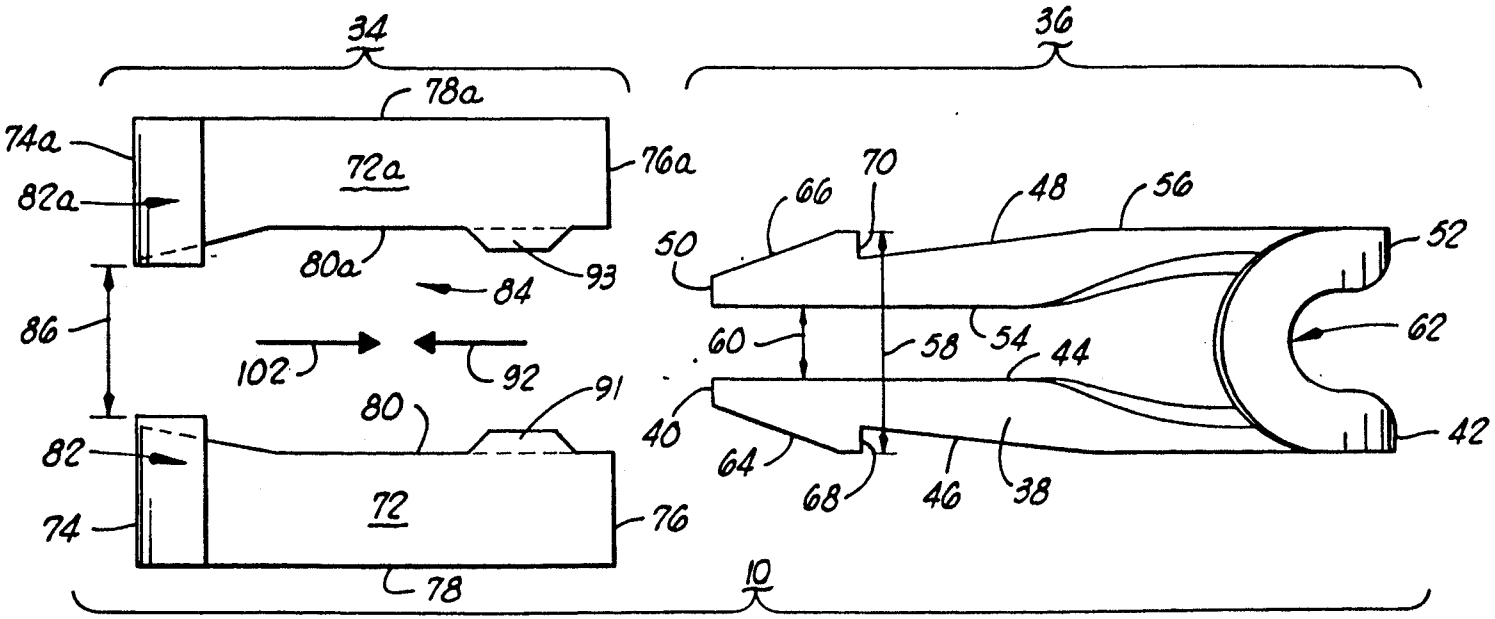
FIG. 1 is a top plan view of a rail-tie fastening assembly showing a rail seat assembly and a rail anchor in an unassembled position, but not showing a base anchor (shown in FIGS. 3, 4 and 5).
Figure 2:
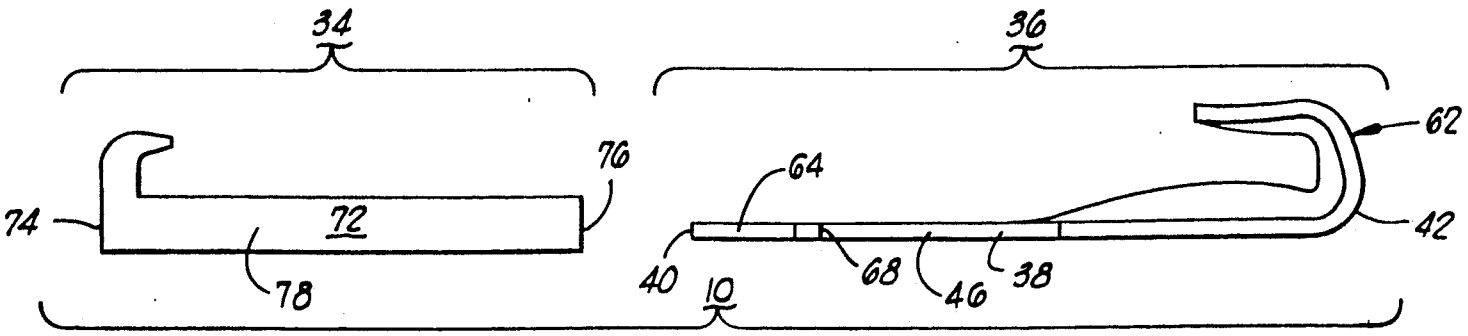
FIG. 2 is a side elevational view of the rail-tie fastening assembly of FIG. 1 showing the rail seat assembly and the rail anchor in the unassembled position, but not showing a base anchor (shown in FIG. 3).
Figure 3A:
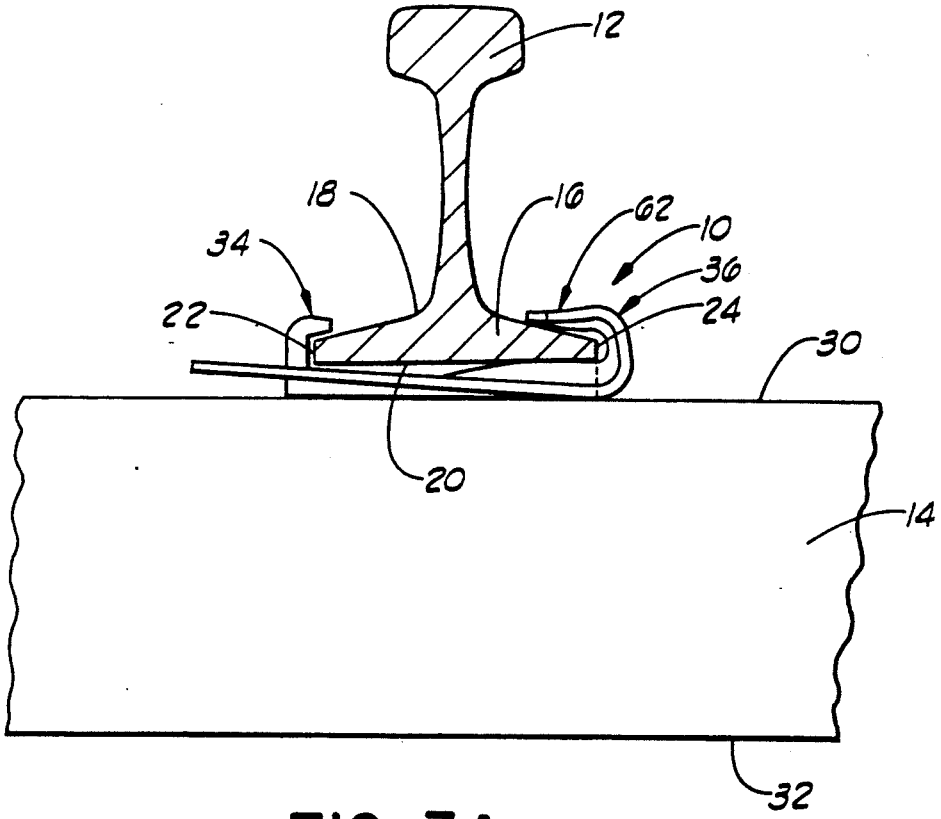
FIG. 3A is a side elevational view showing the rail-tie fastening assembly of FIGS. 1, 2 and 3 connected to a rail (shown in section) and supported on a tie.
Figure 3:
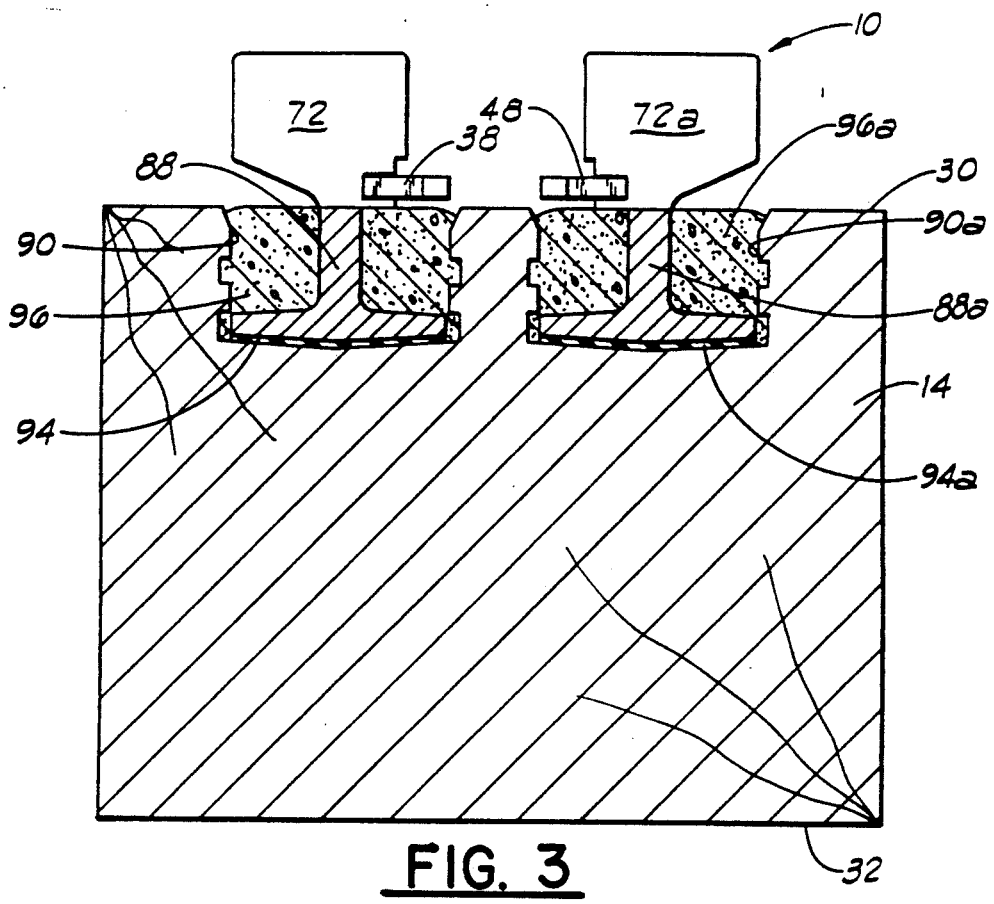
FIG. 3 is a sectional view of a tie showing an end elevational view of the rail seat assembly and showing a portion of the base anchor connected to the rail seat assembly installed on a wood tie.

As shown in FIGS. 1, 2, 3 and 3A the present invention comprises a rail-tie fastening assembly 10 which is adapted to connect a rail 12 (FIG. 3A) to a tie 14 (FIGS. 3 and 3A). The rail 12 (shown in FIG. 3A) includes a rail flange 16 having upper and lower surfaces 18 and 20 and a first side 22 and a second side 24. The tie 14 has an upper and a lower surface 30 and 32 (FIGS. 3 and 3A). The rail-tie fastening assembly 10 includes a rail seat assembly 34 (FIGS. 1, 2 and 3A) and a rail anchor 36 (FIGS. 1, 2 and 3A).

As shown in FIGS. 1 and 2, the rail anchor 36 has a first tine 38 having first and second ends 40 and 42 and first and second sides 44 and 46. The rail anchor 36 also has a second tine 48 having first and second ends 50 and 52 and first and second sides 54 and 56. The second ends 42 and 52 are connected together and the tines 38 and 48 extend in generally parallel planes. The second side 46 of the first tine 38 generally faces away from and is spaced a distance 58 from the second side 56 of the second tine 48. A distance between the first side 44 of the first tine 38 and the first side 54 of the second tine 48 forms an anchor width 60.

An anchor hook assembly 62 (FIGS. 1, 2 and 3A) is connected to the second ends 42 and 52 of the first and second tines 38 and 48. In one embodiment, the tines 38 and 48 and the anchor hook assembly 62 are integrally constructed from a single unitary piece of metallic material.

A tapered portion 64 (FIG. 1) is formed on the second side 46 of the first tine 38, generally near and intersecting the first end 40. A tapered portion 66 (FIG. 6) is formed on the second side 56 of the second tine 48, generally near and intersecting the first end 50 of the second tine 48.

A seat surface 68 (FIG. 1) is formed on the second side 46 of the first tine 38, generally near the beginning of the tapered portion 64. A seat surface 70 (FIG. 1) is formed on the second side 56 of the second tine 48, generally near the beginning of the tapered portion 66. The seat surfaces 68 and 70 cooperate to secure the rail anchor 36 within the rail seat assembly 34.

As shown more clearly in FIGS. 1 and 2, the rail seat assembly 34 includes a first rail seat plate 72 having first and second ends 74 and 76 and first and second sides 78 and 80. A first seat hook 82 is formed on the first end 74 of the first rail seat plate 72. The first seat hook 82 is shaped and adapted to engage the first side 22 of the rail flange 16.

As shown in FIG. 1, the rail seat assembly 34 also includes a second rail seat plate 72*a* which is constructed and operates exactly like the rail seat plate 72 described before, except the rail seat plates 72 and 72*a* are left and right configurations adapted to be disposed on opposite sides of the rail anchor 36. Thus, the various components of the rail seat plate 72*a* are designated in the drawings with the same reference numerals as like components of the rail seat plate 72, except the various components of the rail seat plate 72*a* also include the additional letter designation "a".

As shown in FIGS. 3 and 3A, the rail seat plates 72 and 72*a* each are disposed generally on the upper surface 30 of the tie 14. They are disposed generally in parallel extending planes. As shown more clearly in FIG. 1, the second side 80 of the rail seat plate 72 is spaced a distance from the second side 80*a* of the rail seat plate 72*a*. The second sides 80 and 80*a* cooperate with the spacing therebetween to form an anchor slot 84 in the rail seat assembly 34, and the distance between the second sides 80 and 80*a* comprises a slot width 86.

As shown in FIG. 3, a base anchor 88 is connected to the lower surface of the rail seat plate 72. A second base anchor 88*a* is connected to the lower surface of the rail seat plate 72*a*. In one embodiment, the base anchors 88 and 88*a* are formed integrally with the respective rail seat plates 72 and 72*a*.

As shown in FIG. 3, a cavity 90 is formed in the upper surface 30 of the tie 14. The cavity 90 is sized to receive the base anchor 88. The cavity 90 and the base anchor 88 each are sized so that, when the base anchor 88 is disposed in the cavity 90, the lower surface of the rail seat plate 72 is disposed in a plane generally coplanar with the upper surface 30 of the tie 14.

A second cavity 90*a* (shown in FIG. 3) is formed in the upper surface 30 of the tie 14 and the second cavity 90*a* is constructed and shaped exactly like the cavity 90. The second cavity 90*a* is sized and shaped to receive the base anchor 88*a* for supporting the rail seat plate 72*a* in a manner exactly like that described before with respect to the cavity 90, the base anchor 88 and the rail seat plate 72.

To install the apparatus of the present invention, the two cavities 90 and 90*a* first are formed in the upper surface 30 of the tie 14. The base anchor 88 along with the rail seat plate 72 connected thereto is disposed in the cavity 90 and the base anchor 88*a* along with the rail seat plate 72*a* connected thereto is disposed in the cavity 90*a*. The base anchors 88 and 88*a* each are positioned in the respective cavities 90 and 90*a* so that the rail seat plates 72 and 72*a* are oriented in the aligned, spaced apart manner described before. In this position, the base anchors 88 and 88*a* each are secured in the respective cavities 90 and 90*a* to secure the rail seat assembly 38 to the tie 14.

With the rail seat assembly 34 connected to the tie 14, the rail flange 16 of the rail 12 is positioned generally on the upper surfaces of the rail seat plates 72 and 72*a*. The rail anchor 36 then is positioned so that the first ends 40 and 50 are disposed generally adjacent the anchor slot 84.

In this position, the operator drives the rail anchor 36 in an insertion direction 92 (FIG. 1). As the operator drives the rail anchor 36 in the insertion direction 92, the tapered portions 64 and 66 engage the second sides 80 and 80*a* of the rail seat plates 72 and 72*a* thereby forcing the first ends 40 and 50 generally toward each other. The operator continues to drive the rail anchor 36 in the insertion direction 92 until the tapered portions 64 and 66 have been disposed entirely within the anchor slot 84, thereby resulting in the first and the second tines 38 and 48 being moved generally toward each other to a position wherein the rail anchor 36 has been moved to a compressed position (sometimes referred to herein as the insertion position) and the width 58 has been reduced to about the same size as the slot width 86.

In this insertion position of the rail anchor 36, the operator continues to force or drive the rail anchor 36 in the insertion direction 92 until the seat surfaces 68 and 70 are moved slightly beyond the first ends 74 and 74*a* of the rail seat plates 72 and 72*a*. The seat surfaces 68 and 70 form a reduced width portion of the rail anchor 36 thereby permitting the second sides 46 and 56 to be moved apart to a position wherein the first and the second tines 38 and 48 return to a normal position. In the normal position, the seat surface 68 on the first tine 38 engages a portion of the first end 74 of the rail seat plate 72 and the seat surface 70 on the second tine 48 engages a portion of the first end 74*a* of the rail seat plate 72*a*, thereby securing the rail anchor 36 in the assembled position and in the normal position connected to the rail seat assembly 34.

An ear 91 is formed on the second side 80 of the rail seat plate 72. The ear 91 extends a distance into the anchor sot 84. The ear 91 is spaced a distance above the upper surface of the first tine 38 in an assembled position rail seat assembly 34 and the rail anchor 36.

An ear 93 is formed on the second side 80*a* of the second rail seat plate 72*a*. The ear 93 extends a distance into the anchor slot 84 and is generally aligned with the ear 91 formed on the first rail seat plate 72.

The ears 91 and 93 are positioned on the rail seat plates 72 and 72*a* so that, in an assembled position of the rail seat assembly 34 and the base anchor 36, the ears 91 and 93 each are spaced a distance above the upper surfaces of the first and the second tines 38 and 48 to permit limited vertical movement of the rail flange 16 and the base anchor 36 connected thereto. In an assembled position, the seat hook assembly 62 engages the second side 24 of the rail flange 16 and the seat hooks 82 and 82*a* each engage portions of the first side 22 of the rail flange 16 thereby cooperating to restrain lateral movement of the rail flange 16. The seat hooks 82 and 82*a* each extend a distance over and are spaced a distance generally above the upper surface 18 of the rail flange 16 to cooperate in permitting the limited vertical movement of the rail flange 16 and the base anchor 36 connected thereto. The seat hook assembly 62 extends over the upper surface 18 of the rail flange 16 and the seat hook assembly 62 engages portions of the upper and lower surfaces 18 and 20 of the rail flange 16 to restrain longitudinal movement of the rail flange 16 in an assembled position of the rail seat assembly 34 and the base anchor 36.

After connecting the rail seat assemblies 38 to the tie 14, the tie 14 with the four rail seat assemblies 34 secured thereon is treated with creosote or any other suitable preservative in the case of wood ties 14.

One system for securing the rail seat plate 72 in the cavity 90 is illustrated in FIGS. 3. An adhesive 94 initially is disposed on the bottom surface of the cavity 90. The base anchor 88 with the rail seat plate 72 connected thereto then is lowered into the cavity 90 to a position wherein the lower surface is disposed on the adhesive 94. The remainder of the space in the cavity 90 not occupied by the base anchor 88 is filled with a potting compound 96. The adhesive 94 and potting compound 96 are cured. The potting compound 96 cooperates with the adhesive 94 to fill the remaining space in the cavity 90 and to secure the base anchor 88 in the cavity 90. The rail seat plate 72*a* is secured to the tie 14 in exactly the same manner.

One suitable adhesive which may be used as the adhesive 94 is an amine hardened epoxy resin such as a polyamidoamine hardened didiglycidyl ether of bisphenol A. Following standard practice, a freshly milled, clean, dry wood surface substantially improves the bond to epoxy/epoxy potting compound.

It should be noted that an adhesive primer can be disposed on the metal base anchor 88 to render the metal bondable to the adhesive 94 or the potting compound 96.

To remove the rail anchor 36 from assemblage with the rail seat assembly 34, the operator must move the first tine 38 and the second tine 48 generally toward each other to the insertion position wherein the seat surfaces 68 and 70 become disengaged from the first ends 74 and 74*a* of the rail seat plates 72 and 72*a*. In this insertion position of the rail anchor 36, the rail anchor 36 then can be moved in a removal direction 102 (FIG. 1) through the anchor slot 84 to a position wherein the rail anchor 36 is disengaged from the rail seat assembly 34.

A rail-tie fastening assembly constructed exactly like the rail-tie fastening 10 described above was disclosed and claimed in the co-pending application entitled "Rail-Tie Fastening Assembly", filed on Sep. 24, 1989, U.S. Ser. No. 414,226, which is a continuation-in-part of the application entitled "Rail-Tie Fastening Assembly", filed on Dec. 3, 1987, U.S. Ser. No. 128,174, now U.S. Pat. No. 4,874,128. The disclosure of U.S. Pat. No. 4,874,128, and U.S. Ser. No. 414,226 each specifically are incorporated herein by reference.

EMBODIMENT OF FIGS. 4 AND 5

Figure 4:
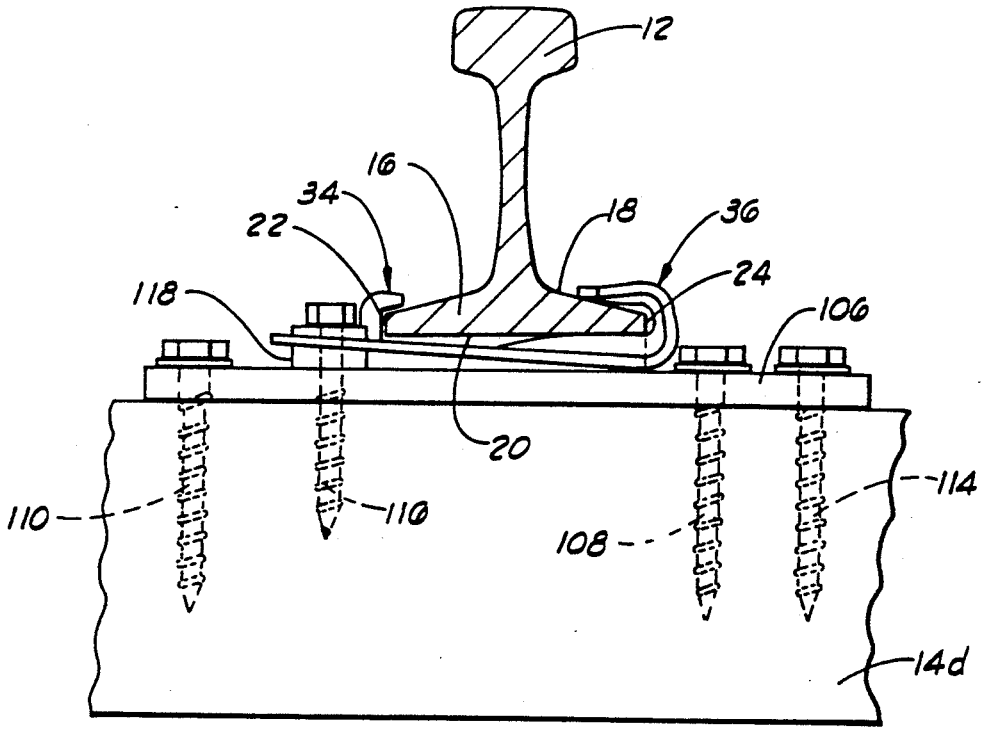
FIG. 4 is a partial side elevational, partial sectional view showing a modified rail-tie fastening assembly with the rail seat assembly lag screwed to a tie, and showing a stop means for substantially preventing the rail anchor from being moved from the normal portion to the collapsed position in one position of the stop means.
Figure 5:
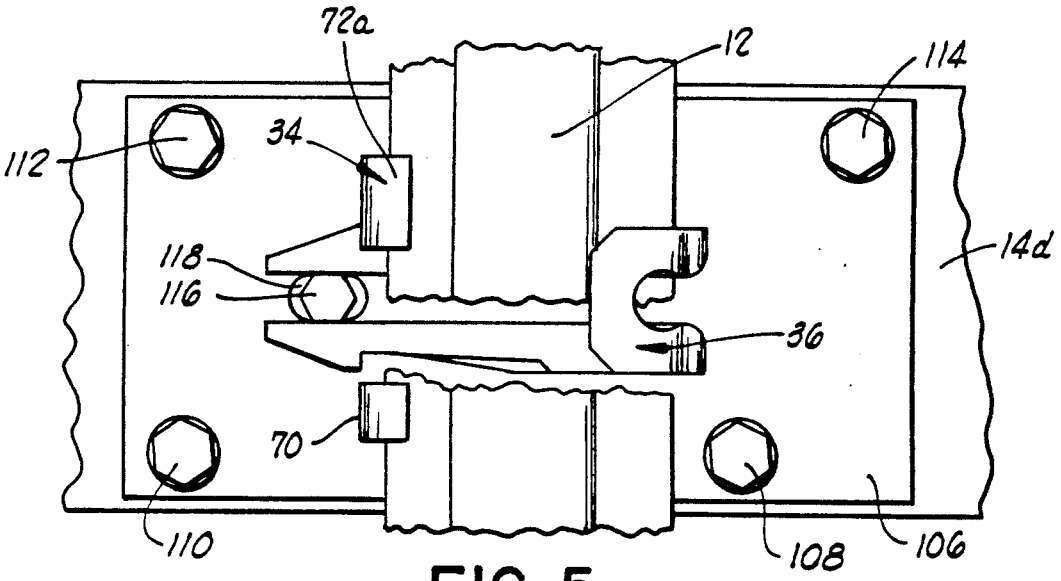
FIG. 5 is a top plan view of the modified rail-tie fastening assembly of FIG. 4 showing the stop means.

Shown in FIGS. 4 and 5 is the rail seat assembly 34 and the rail anchor 36 constructed in the manner described before connected to a tie 14*d*. The rail seat plates 72 and 72*a* are formed on or welded or adhesively connected to a tie plate 106. The tie plate 106 is connected to the upper surface of the tie 14*d* via screws or other suitable attachment means 108, 110, 112 and 114. In this embodiment, the rail seat assembly 34 and the rail anchor 36 are connected to the upper surface of the tie 14*d* via the tie plate 106, and base anchors embedded in the tie like the base anchors 88 described before are not utilized.

A screw 116 is extended through a stop head 118, through the tie plate 106 and through a portion of the tie 14*d*. The screw 116 is disposed so that the stop head 118 is positioned between the tines 38 and 48 in the assembled position of the rail seat assembly 34 and the rail anchor 36 and in the normal position of the rail anchor 36. The stop head 118 prevents the tines 38 and 48 from being inadvertently moved to the insertion position, thereby providing additional assurance that the rail anchor 36 will remain connected to the rail seat assembly 34. To remove the rail anchor 36, it first is necessary to remove the stop head 118 and, then, the tines 38 and 48 can be moved to the insertion position and disassembled from the rail seat assembly 34.

The stop head 118 can be used with any of the rail-tie fastening assemblies described herein having a pair of spaced apart tines.

EMBODIMENT OF FIGS. 6, 7, AND 9

Shown in FIGS. 6, 7, 8 and 9 is a modified stop means 120. The stop means 120 comprises a base 122 with two legs 124 and 126 extending a distance generally downwardly from the base 122 forming an overall U-shaped structure. One end of a flat plate, spring member 128 is connected to one end of the base 122 and the spring member 128 extends a distance outwardly from the base 122 and is curved upwardly so that the spring member 128 extends a distance outwardly and upwardly from the base 122.

Figure 6:
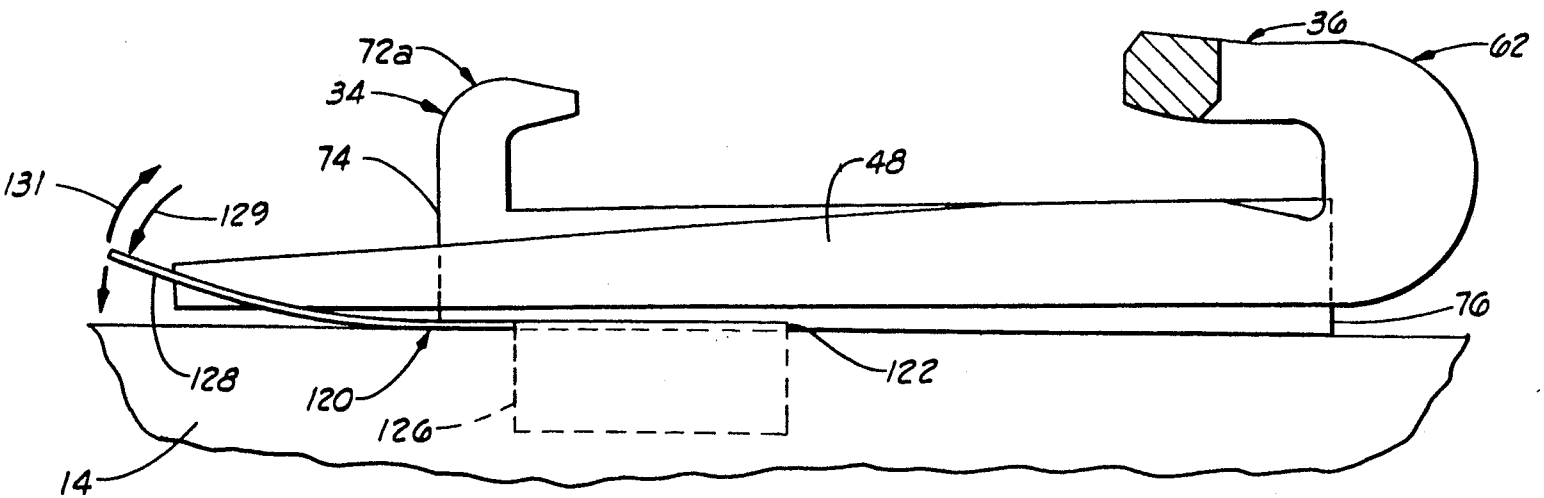
FIG. 6 is a side elevational view, partial sectional view showing a rail seat plate and a portion of a rail anchor with a modified stop means for substantially preventing the rail anchor from being moved from the normal position to the collapsed or insertion position in one position of the stop means.

The legs 124 and 126 of the stop means 120 are anchored in the upper surface of the tie and disposed between the rail seat plates 72 and 72*a* so that the spring member 128 extends a distance outwardly and upwardly from the second ends 76 and 76*a* of the rail seat plates 72 and 72*a* (only the rail seat plate 72*a* is shown in FIG. 6). The spring member 128 is sized to have a width 130 (FIG. 7) slightly less than the width 60. The stop means 120 is positioned between the rail seat plates 72 and 72*a* so that the spring member 128 is disposed generally between the first and the second tines 38 and 48 of the rail anchor 36.

In operation, the rail anchor 36 is moved to the insertion position as the rail anchor 36 is inserted between the rail seat plates 78 and 78*a* thereby decreasing the width 60. As the rail anchor 36 moves through the anchor slot 84 in the insertion position, the ends of the first and the second tines 38 and 48 engage the upper surface of the spring member 128 thereby forcing the spring member 128 in a downward direction 129 (FIG. 6) toward the upper surface of the tie 14. When the rail anchor 36 is in the assembled position, the rail anchor 36 is moved to the normal position and the spring member 128 is springingly moved in an upward direction 131 (FIG. 6) between the first and the second tines 38 and 48. In this position, the spring member 128 is engageable with the first and the second tines 38 and 48 for substantially preventing the rail anchor 36 from being moved from the normal position to the insertion position.

When it is desired to remove the rail anchor 36, the spring member 128 first must be moved in the downward direction 129 (FIG. 6) to a position generally adjacent the upper surface of the tie 14. Then, the rail anchor 40 may be moved to the insertion position and removed from between the rail seat plates 72 and 72*a*.

EMBODIMENT OF FIGS. 10 AND 11

Figure 10:
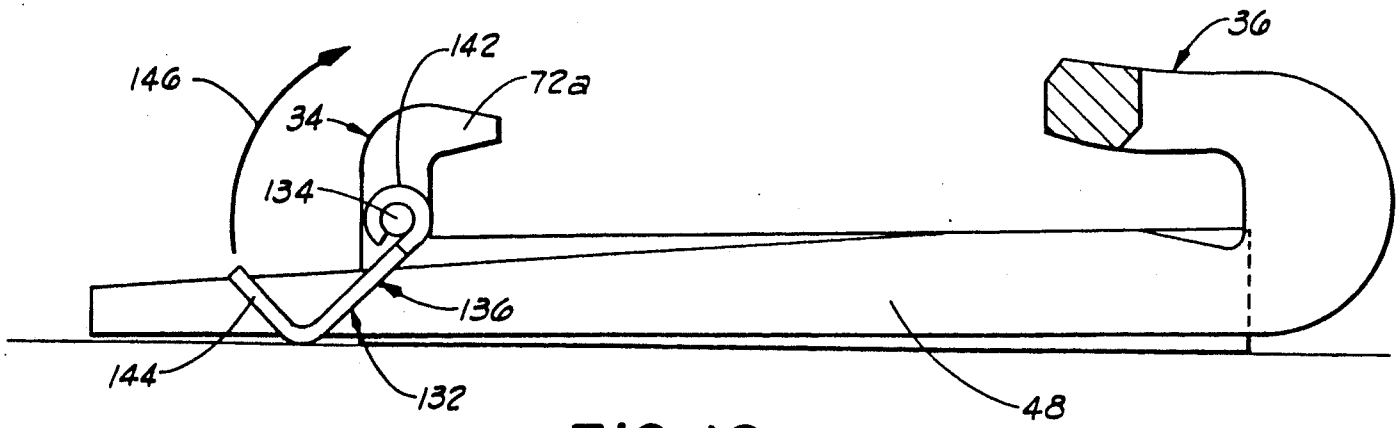
FIG. 10 is a side elevational view showing a portion of a rail seat plate and a side elevational view, partial sectional view of a portion of a rail anchor with another modified stop means for substantially preventing the rail anchor from being moved from the normal position to the collapsed or insertion position in one position of the stop means.
Figure 7:
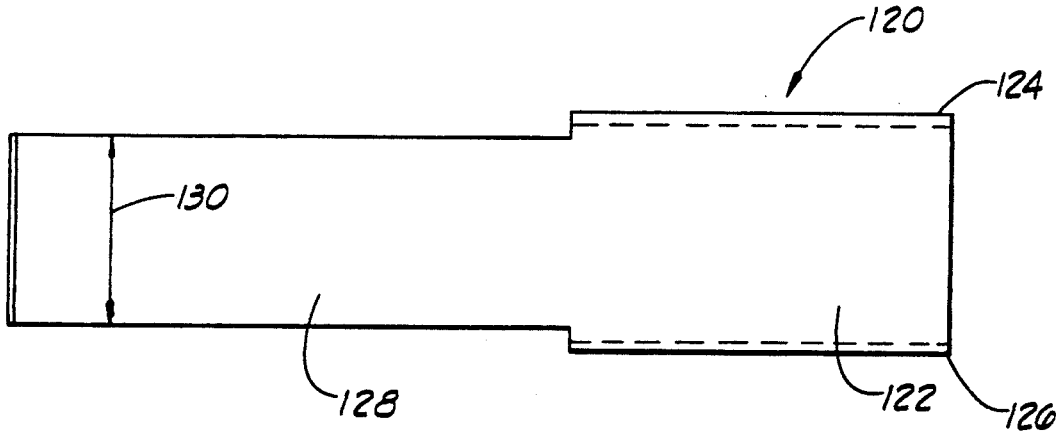
FIG. 7 is a top elevational view of the stop means shown in FIG. 6.
Figure 8:
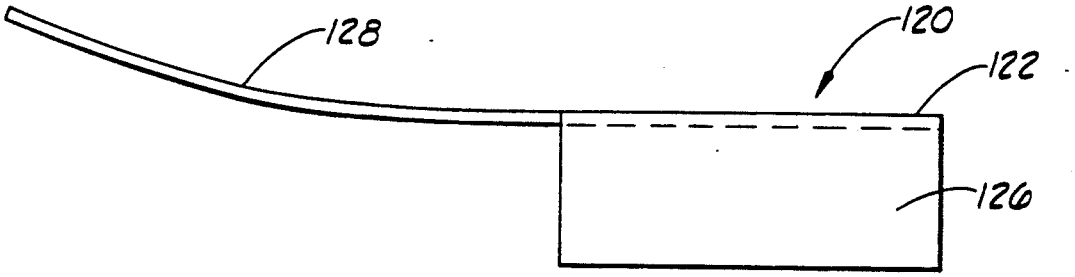
FIG. 8 is a side elevational view of the stop means shown in FIGS. 6 and 7.
Figure 9:
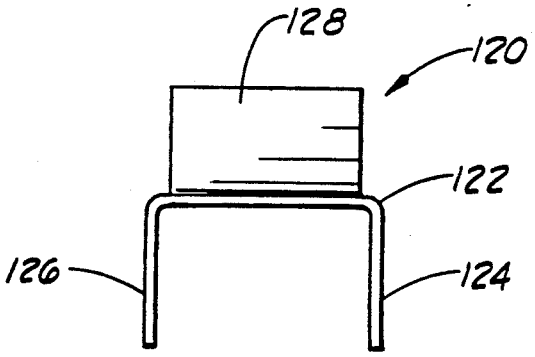
FIG. 9 is an end elevational view of the stop means shown in FIGS. 6, 7 and 8.
Figure 11:
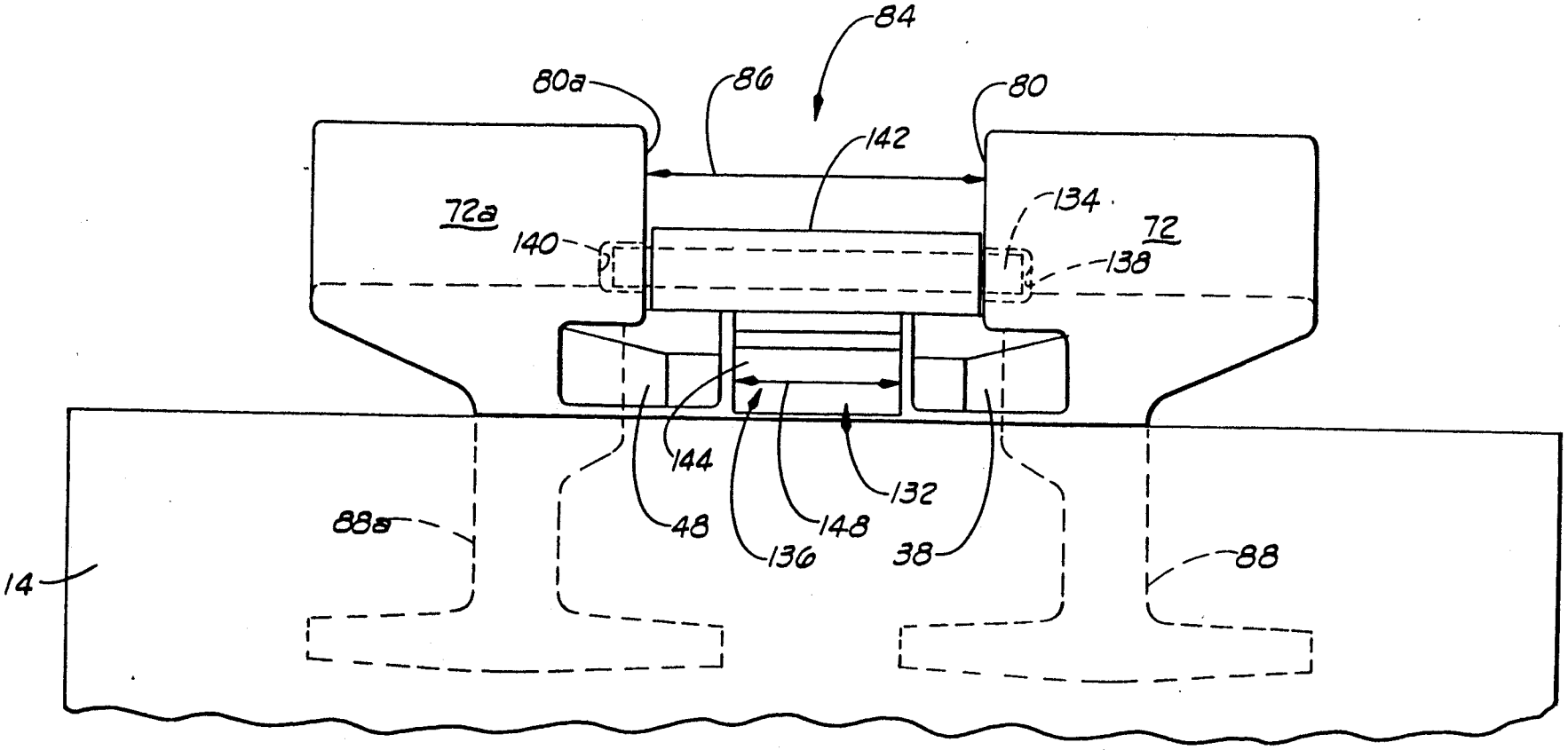
FIG. 11 is an end elevational view showing two rail seat plates and a portion of rail anchor connected to the two rail seat plates with the modified stop means shown in FIG. 10 connected to the rail seat plates.

Shown in FIGS. 10 and 11 is another modified stop means 132 adapted to be used with the rail seat plates 72 and 72*a* and the rail anchor 36 described in detailed before. The stop means 132 is connected to the rail seat plates 72 and 72*a*.

The stop means 132 comprises a shaft 134 and a latch 136.

One end of the shaft 134 is secured in an opening 138 formed in the second side 80 of the rail seat plate 72. The opposite end of the shaft 134 is secured in an opening 140 formed in the second side 80*a* of the rail seat plate 72*a*. The shaft 134 extends generally between the rail seat plates 72 and 72*a* and generally across the slot width 86.

An end 142 of the latch 136 is pivotally secured to the shaft 134. The latch 136 extends a distance downwardly from the shaft 134 and includes a stop portion 144 which extends generally upwardly forming an L-shaped latch 136.

When the rail anchor 36 is moved through the anchor slot 84, the ends of the tines 38 and 48 engage the latch 136 and pivotally move the latch 136 in an upwardly direction 146 (FIG. 10) to a position wherein the latch 136 is disposed generally on the upper surfaces of the tines 38 and 48. The stop portion 144 of the latch 136 has a width 148 (FIG. 11) which is slightly less than the width 60 between the tines 38 and 48. Thus, when the rail anchor 40 is moved into the assembled position and then moved to the normal position, the latch 136 automatically falls between the tines 38 and 48 so that the latch 136 is positioned generally between the tines 38 and 48 for preventing the tines 38 and 40 from being moved to the insertion position. When it is desired to remove the rail anchor 36, the latch 136 is moved in the upwardly direction 146 to a position wherein the tines 38 and 48 can be moved from the normal position to the insertion position for removing the rail anchor 36 from the rail seat assembly 34.

EMBODIMENT OF FIG. 12

Figure 12:
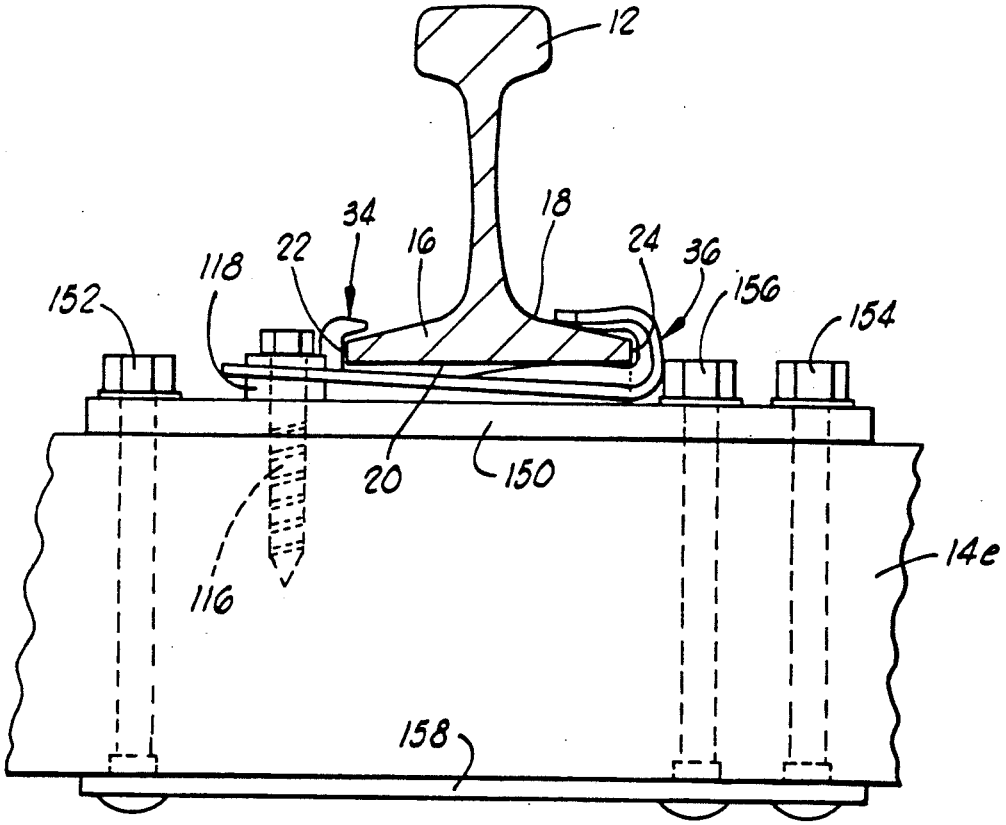
FIG. 12 is a partial side elevational, partial sectional view showing another modified rail-tie fastening assembly bolted to a tie including a bottom anchor plate.

Shown in FIG. 12 is the rail seat assembly 34 and the rail anchor 36 constructed in the manner described before, except base anchors are not utilized in this embodiment, connected to a tie 14*e*. The rail seats 72 and 72*a* are formed on, welded or adhesively connected to a tie plate 150. The tie plate 150 is connected to the upper surface of the tie 14*e* via bolts or other suitable attachment means, only three bolts 152, 154 and 156 being shown in FIG. 12. The bolts 152, 154 and 156 extend through the tie plate 150 and through the tie 14*e* and a distance beyond the lower surface of the tie 14*e*.

A lower tie plate 158 is disposed adjacent the lower surface of the tie 14*e*. The bolts 152, 154 and 156 also extend through the lower tie plate 158 and the bolts 152, 154 and 156 are connected to the lower tie plate 158.

EMBODIMENT OF FIG. 13

Figure 13:
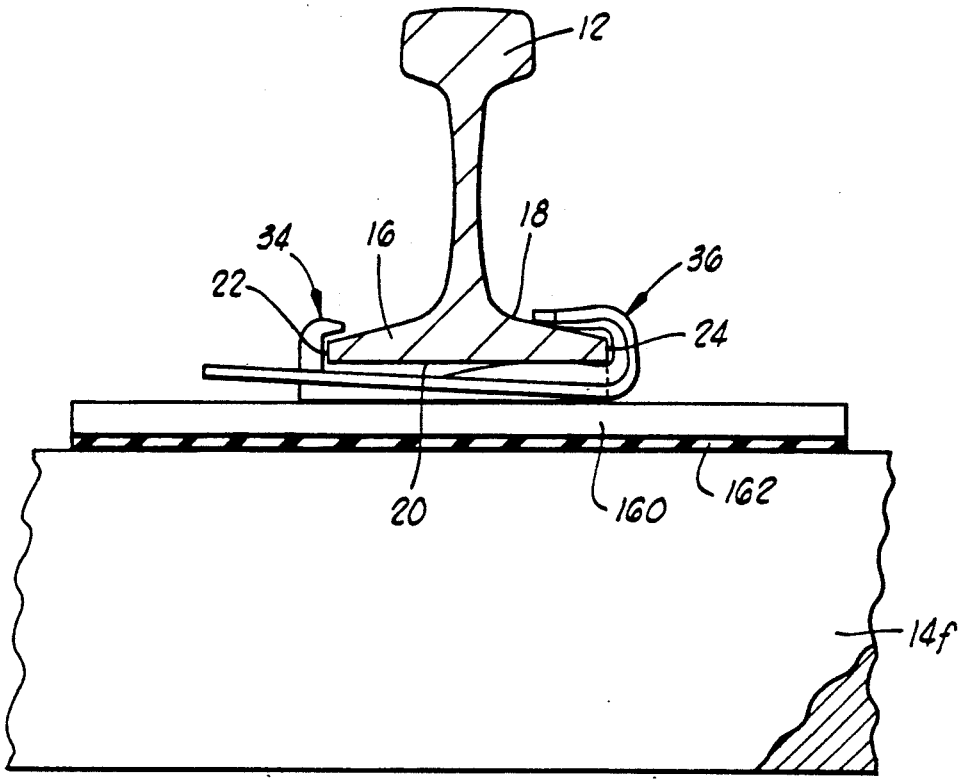
FIG. 13 is a partial side elevational, partial sectional view showing yet another modified rail-tie fastening assembly with rail seats connected to a plate which is adhesively connected to a tie.

Shown in FIG. 13 is the rail seat assembly 34 and the rail anchor 36 constructed in a manner described before, except base anchors are not utilized in this embodiment, connected to a tie 14*f*. The rail seat assembly 34 (the rail seats 72 and 72*a*) is welded or adhesively connected to a tie plate 160. The tie plate 160 is disposed on the upper surface of the tie 14*e*. The tie plate 160 is connected to the tie 14*e* via an adhesive 162.

EMBODIMENT OF FIG. 14

Figure 14:
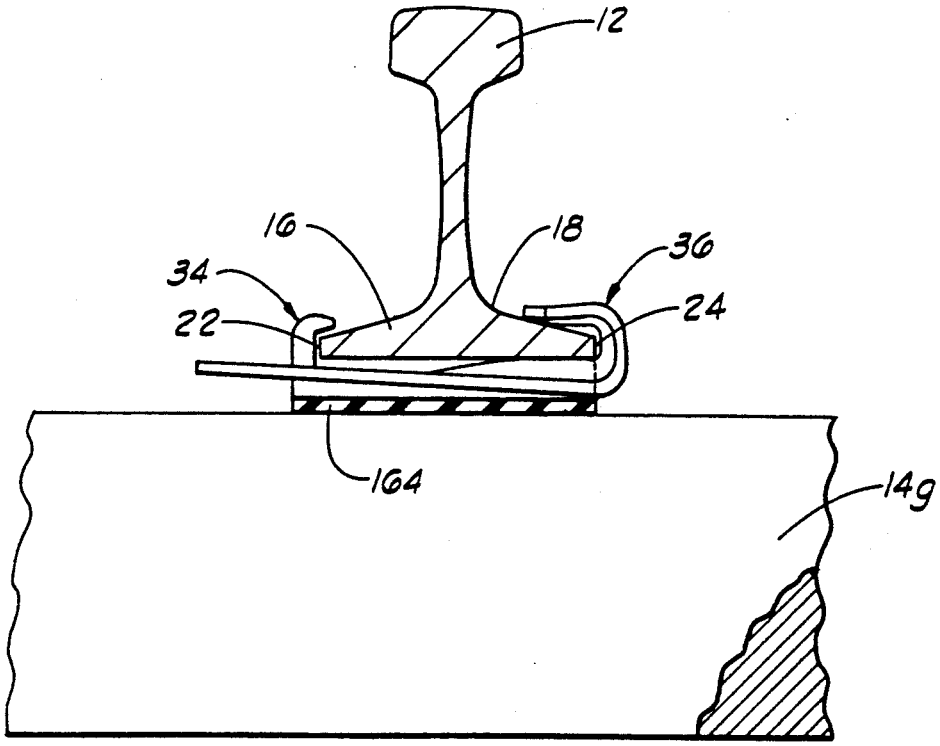
FIG. 14 is a partial sectional, partial side elevational view showing the rail seat assembly adhesively connected to the upper surface of a tie and showing the rail seat assembly and rail anchor connected to a rail.

Shown in FIG. 14 is the rail seat plate 72 or 72*a* connected to the upper surface of a tie 14*g* by way of an adhesive 164. In this embodiment, both of the rail seat plates 72 and 72*a* are directly connected to the upper surface of the tie 14*g* by way of the adhesive 164, and base anchors are not utilized in this embodiment.

EMBODIMENT OF FIG. 15

Figure 15:
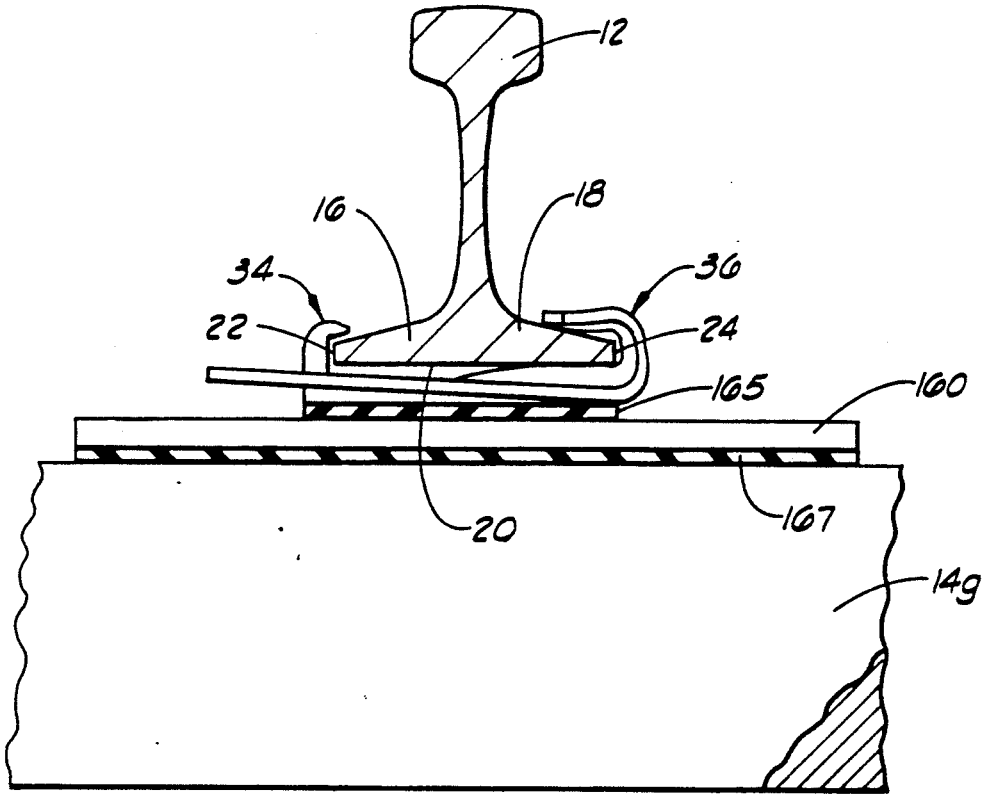
FIG. 15 is a partial sectional, partial side elevational view showing the rail seat assembly adhesively connected to a tie plate and showing the tie plate adhesively connected to the upper surface of the tie.

Shown in FIG. 15 is the rail seat assembly 34 and the rail anchor 36 constructed in a manner described before in connection with FIG. 15, and base anchors are not utilized in this embodiment. The rail seat assembly 34 (the rail seats 72 and 72*a*) is adhesively connected to the tie plate 160 via an adhesive 165. The tie plate 160 is disposed on the upper surface of the tie 14*g*. The tie plate 160 is connected to the tie 14*g* via an adhesive 167.

EMBODIMENT OF FIG. 16

Figure 16:
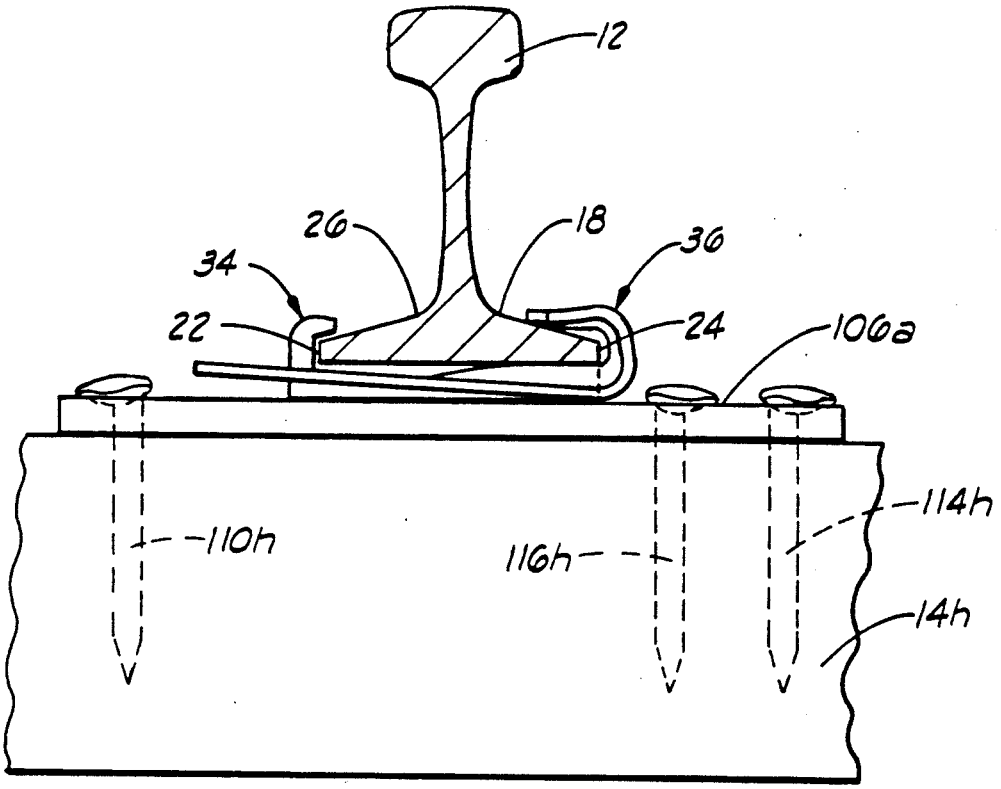
FIG. 16 is a partial sectional, partial side elevational view showing a rail seat assembly connected to a tie plate with the tie plate being connected to a tie via track spikes and showing the rail seat assembly and the rail anchor connected to a rail.

Shown in FIG. 16 is the rail seat assembly 34 and the rail anchor 36 connected to a tie plate 106*a*. The tie plate 106*a* is connected to the tie 14*h* by way of spikes (only three of the spikes being shown in FIG. 16 and designated therein by the reference numerals 110*h*, 114*h* and 116*h*). The tie plate 106*a* is constructed like the tie plate 106 shown in FIG. 4 and described before, except the tie plate 106*a* is connected to the rail 14*h* by way of the spikes 110*h*, 114*h* and 116*h* instead of the screws shown in FIG. 4. Base anchors are not utilized in this embodiment.

EMBODIMENT OF FIGS. 17, 18 AND 19

Figure 19:
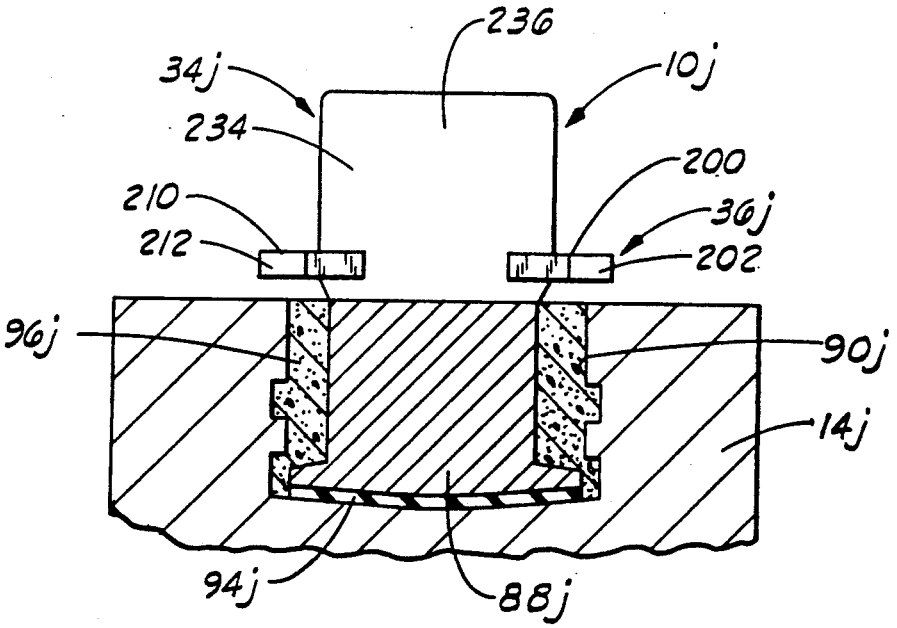
FIG. 19 is a sectional view of a portion of a tie showing an end elevational view of the rail seat assembly and showing a portion of the base anchor connected to the rail seat assembly installed on a wood tie, the rail-tie fastening assembly being the modified rail fastening assembly shown in FIGS. 17 and 18.
Figure 17:
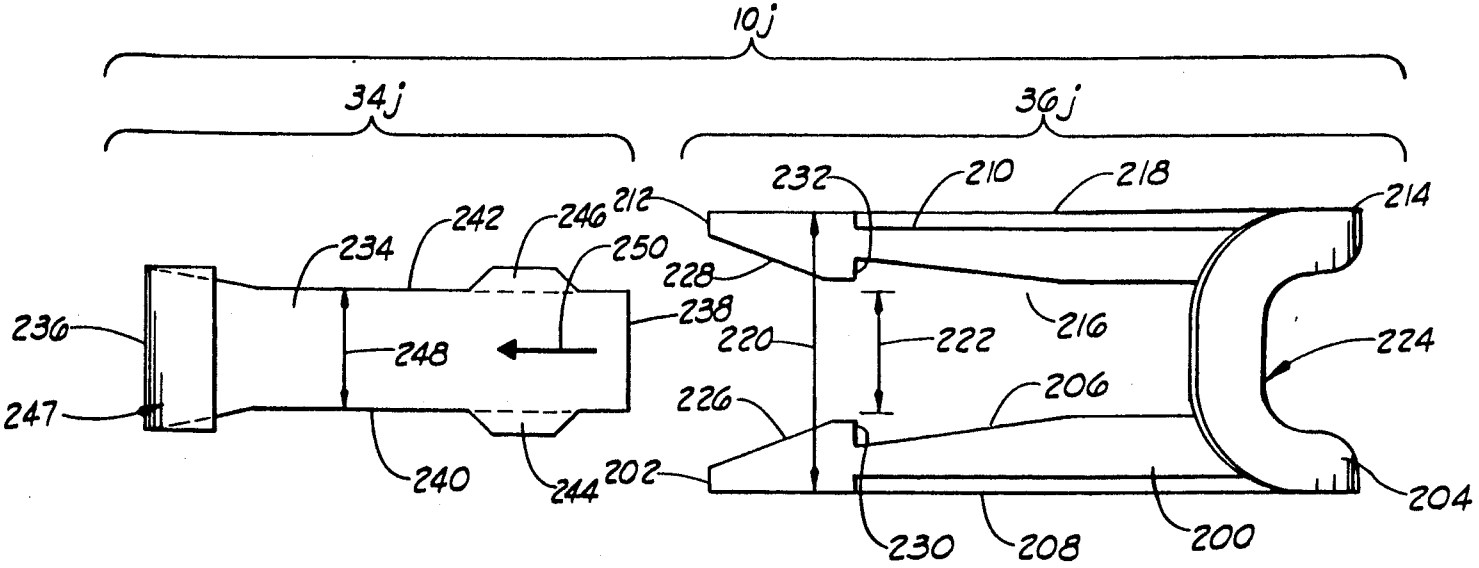
FIG. 17 is a top plan view, similar to FIG. 1, but showing a modified rail-tie fastening assembly with a modified rail seat assembly and a modified rail anchor being shown in an unassembled position, but not showing a base anchor.
Figure 18:
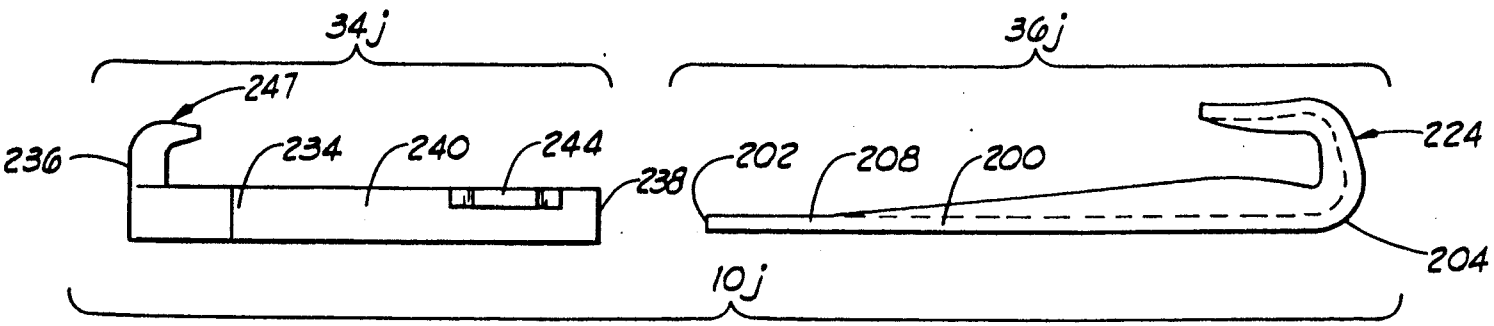
FIG. 18 is a side elevational view of the modified rail-tie fastening assembly of FIG. 17 showing the rail seat assembly and the rail anchor in an unassembled position, but not showing a base anchor.

Shown in FIGS. 17, 18 and 19 is a modified rail-tie fastening assembly 10*j* adapted to connect a rail to a tie 14*j* (FIG. 19). The rail-tie fastening assembly 10*j* includes a modified rail seat assembly 34*j* and a modified rail anchor 36*j*.

The rail anchor 36*j* has a first tine 200 having first and second ends 202 and 204 and first and second sides 206 and 208. The rail anchor 36*j* also has a second tine 210 having first and second ends 212 and 214 and first and second sides 216 and 218. The second ends 204 and 214 are connected together and the tines 200 and 210 extend in generally parallel planes.

The second side 208 of the first tine 200 generally faces away from and spaced a distance 220 from the second side 218 of the second tine 210. The distance between the first side 206 of the first tine 200 and the first side 216 of the second tine 206 forms an anchor width 222.

An anchor hook assembly 224 is connected to the second ends 204 and 214 of the first and the second tines 200 and 210. In this embodiment, the tines 200 and 210 and the anchor hook assembly 224 are integrally constructed from a single unitary piece of metallic material.

A tapered portion 226 is formed on the first side 206 of the first tine 200 generally near and intersecting the first end 202 thereof. A tapered portion 228 is formed on the first side 216 of the second tine 206, generally near and intersecting the first end 212 of the second tine 206. A seat surface 230 is formed on the first side 206 of the first tine 200, generally near the beginning of the tapered portion 226. A seat surface 232 is formed on the first side 216 of the second tine 206, generally near the beginning of the tapered portion 228. The seat surfaces 230 and 232 cooperate to secure the rail anchor 36*j* within the rail seat assembly 34*j*.

The rail seat assembly 34*j* comprises a rail seat plate 234. The rail seat plate 234 has a first end 236, a second end 238, a first side 240 and a second side 242. An ear 244 is formed on the first side 240 and an ear 246 is formed on the second side 242. The rail seat plate 234 has a width 248 which forms an anchor slot. A seat hook 247 is formed on the first end 236 of the rail seat plate 234.

As shown in FIG. 19, a modified base anchor 88*j* is connected to the lower surface of the rail seat plate 234. In one embodiment, the base anchor 88*j* is integrally formed with the rail seat plate 234.

The rail anchor 88*j* is secured in a cavity 90*j* formed in the tie 14*j* via adhesive 94*j* and a potting compound 96*j* in a manner like that described before with respect to either of the seat assembly 72 and 72*a* and the respective base anchors 88 and 88*a*. It should be noted that the rail seat plate 234 may be adhesively connected to the upper surface of the tie 14, in a manner like that described before in connection with FIG. 14 or the rail seat plate 234 may be connected to a plate which adhesively connected to the tie 14, in a manner like that described before in connection with FIG. 13. In general, the rail seat plate 234 may be connected to the upper surface of the tie 14, in a manner like that described before.

With the rail seat assembly 34*j* connected to the tie 14*j*, the rail flange is positioned generally on the upper surface of the rail seat plate 234. The rail anchor 36*j* then is positioned so that the first ends 202 and 212 of the tines 200 and 206 are disposed generally adjacent the anchor slot formed by the width 248 between the opposite sides 240 and 242 of the rail seat plate 234.

In this position, the operator drives the rail anchor 36*j* in an insertion direction 250 (FIG. 17). As the operator drives the rail anchor 36*j* in the insertion direction 250, the tapered portions 226 and 228 engage the first and the second sides 240 and 242 respectively thereby forcing the first ends 202 and 204 generally away from each other since the anchor width 222 is less than the width 248 of the rail seat plate 234. In this expanded position (sometimes referred to herein as the insertion position) of the rail anchor 36*j*, the operator continues to force or drive the rail anchor 36*j* in the insertion direction 250 until the seat surfaces 230 and 232 are moved slightly beyond the first end 236 of the rail seat plate 234. In this position, the tines 200 and 206 are moved back to a normal position. In the normal position, the seat surfaces 230 and 232 engage the first end 236 of the rail seat plate 234 thereby securing the rail anchor 36*j* in the assembled position and in the normal position connected to the rail seat assembly 34*j*.

The rail seat assembly 34*j* and the rail anchor 36*j* cooperate to secure the rail flange on the rail fastening assembly 10*j* in a manner exactly like that described before with respect to the rail fastening assembly 10. The anchor hook assembly 224 engages the second side of the rail flange and a portion of the anchor hook assembly 224 extends over and engages a portion of the upper and lower surfaces of the rail flange in the assembled position and in the normal position of the rail anchor 36*j* connected to the rail seat assembly 34*j*. The seat hook 247 engages the first side of the rail flange and a portion of the seat hook 247 extends over and is spaced a distance above the upper surface of the rail flange in the assembled position and in the normal position of the rail anchor 36*j* connected to the rail seat assembly 34*j*. The tines 206 and 208 are disposed generally under the ears 244 and 246 and a space between the ears 244 and 246 and the upper surfaces of the tines 200 and 206 cooperates to permit limited vertical movement of the rail and the rail anchor 36*j* connected thereto in a manner exactly like that described before with respect to the rail fastening assembly 10. The engagement between the seat hook 247 and the first side of the rail flange and the engagement between the anchor hook assembly 36*j* and the second side of the rail flange restrains lateral movement of the rail and the engagement between the anchor hook assembly 224 and the upper and the lower surfaces of the rail flange restrains longitudinal movement of the rail in an assembled position of the rail seat assembly 34*j* and the rail anchor 36*j*.

Changes may be made in the various components, elements and assemblies described herein and changes may be made in the steps or sequence of steps of the methods described herein without departing from the spirit and the scope of the invention as define in the following claims.

What is claimed is:

1. A rail-tie fastening assembly for connecting a rail having a rail flange with an upper surface, a lower surface, a first side and a second side to a tie having an upper surface, comprising:

a rail seat plate connectable to the upper surface of the tie having a first end, a second end, a first side, and a second side, the rail seat plate having a predetermined width extending generally between the first and the second sides thereof, a seat hook being connected to the first end of the rail seat plate, said seat plate further having ear means attached thereto, and comprising:

a rail anchor, comprising:

a first tine having a first end, a second end, a first side, a second side, an upper surface and a lower surface;

a second tine having a first end, a second end, a first side, a second side, an upper surface and a lower surface; and an anchor hook assembly connecting the second end of the first tine to the second end of the second tine with the first and the second tines extending in substantially parallel planes, the second side of the first tine being spaced a separation distance from the second side of the second tine, the first and the second tines being movable between a first normal undeflected state and a second deflected state, said rail anchor being movable with respect to said rail seat plate along an insertion direction from a first preinsertion position where said tines are in said first state, to a second insertion position where said tines are in said second state and the first tine engages a portion of the first side of the rail seat plate and the second tine engages a portion of the second side of the rail seat plate and the first and the second tines are moved generally apart thereby increasing the separation distance therebetween, to a third assembled position wherein the first ends of the first and the second tines extend a distance beyond the first end of the rail seat plate and the first and second tines return to the first state and the rail anchor is connected to the rail seat plate, the seat hook being engageable with the first side of the rail flange and the anchor hook assembly being engageable with the second side of the rail flange to restrain lateral movement of the rail flange in the assembled position of the rail anchor and the seat plate, said anchor hook assembly being engageable with a portion of the upper and the lower surfaces of the rail flange in the assembled position of the rail anchor and the rail seat plate for restraining longitudinal movement of the rail, the ear means on the rail seat assembly being spaced a distance above the upper surfaces of the first and the second tines in the assembled position of the rail anchor and the rail seat assembly, and the seat hook extending a distance generally over and being spaced a distance from the upper surface of the rail flange for cooperating with the ear means to permit limited vertical movement of the rail and the rail anchor connected thereto in the assembled position of the rail anchor and the rail seat plate.

2. The rail-tie fastening assembly of claim 1 wherein the rail anchor is defined further to comprise:

seat engaging means formed on the rail anchor for engaging a portion of the rail seat plate in the assembled position of the rail anchor connected to the rail seat plate and in the normal undeflected state of the rail anchor for securing the rail anchor in the assembled position connected to the rail seat plate.

3. The rail-tie fastening assembly of claim 2 wherein the seat engaging means is defined further as engaging a portion of the first end of the rail seat plate in the normal undeflected state of the rail anchor in the assembled position of the rail anchor connected to the rail seat plate.

4. The rail-tie fastening assembly of claim 1 wherein the first tine is defined further as having a tapered portion formed on the first side generally near and intersecting the first end, and wherein the second tine is defined further as having a tapered portion formed on the first side generally near the first end, the tapered portions on the first and the second tines cooperating to define a first end width less than the width of the rail seat plate in the normal undeflected state of the rail anchor, the tapered portions of the first and the second tines being engageable with the rail seat plate for moving the tines to the undeflected state as the rail anchor is moved in the insertion direction.

5. The rail-tie fastening assembly of claim 4 wherein the first tine is defined further to comprise a seat surface formed on the first side generally near the beginning of the tapered portion and spaced a distance from the first end of the first tine, the seat surface generally facing the second end of the first tine, and wherein the second tine is defined further to comprise a seat surface formed on the first side generally near the beginning of the tapered portion and spaced a distance from the first end, the seat surface on the first tine being generally aligned with the seat surface on the second tine, the first ends of the first and the second tines extending a distance beyond the first end of the rail seat plate in the assembled position of the rail anchor and the rail seat plate and the first and the second tines being moved from the deflected state to the normal position in the assembled undeflected state of the rail anchor and the rail seat plate, the seat surfaces on the first and the second tine engaging portions of the first end of the rail seat plate in the assembled position of the rail anchor connected to the rail seat plate to secure the rail anchor in the assembled position and prevent movement in the rail anchor in a direction generally from the first end toward the second end of the rail seat plate.

6. The rail-tie fastening assembly of claim 1 wherein the tie is defined further as comprising a cavity formed in the upper surface and extending a distance into the tie, and wherein the rail-tie fastening assembly is defined further to comprise:

base anchor means connected to the lower surface of the rail seat plate, the base anchor means extending a distance from the lower surface of the rail seat plate, the base anchor means being disposable within the cavity in the tie to a position wherein the lower surface of the rail seat plate is disposed in a plane generally coplanar with the upper surface of the tie; and means for securing the base anchor means in the cavity in the tie.

7. The rail-tie fastening assembly of claim 1 wherein the ear means is further defined to comprise:

an ear connected to the first side of the rail seat plate and extending a distance generally outwardly from the first side of the rail seat plate, the ear being spaced a distance above the upper surface of the first tine in the assembled position of the rail anchor connected to the rail seat plate; and an ear connected to the second side of the rail seat plate and extending a distance generally outwardly from the second side of the rail seat plate, the ear being spaced a distance above the upper surface of the second tine in the assembled position of the rail anchor connected to the rail seat plate.

* * * * *

UNITED STATES PATENT AND TRADEMARK OFFICE

CERTIFICATE OF CORRECTION

PATENT NO. : 5,165,599

DATED : November 24, 1992

INVENTOR(S) : S. Hudson Owen and Paul A. Wolf

It is certified that error appears in the above-indentified patent and that said Letters Patent is hereby corrected as shown below:

Column 11, line 47, delete "undeflected state" and insert --deflected state--

Signed and Sealed this

Seventh Day of October, 1997

*Attest:*

*Attesting Officer*

Bruce Lehman

BRUCE LEHMAN

*Commissioner of Patents and Trademarks*

Disclaimer and Dedication 5,165,599—S. Hudson Owen, Marshfield, Wis.; Paul A. Wolff, Oklahoma City, Okla. RAIL-TIE FASTENING SYSTEMS. Patent dated Nov. 3, 1992. Disclaimer and dedication filed Apr. 30, 2003, by the assignee, Kerr-McGee Chemical LLC.

Hereby disclaims and dedicates to the Public, the remaining term of said patent.

*(Official Gazette, July 15, 2003)*